US006640719B1

(12) United States Patent
Pacella et al.

(10) Patent No.: US 6,640,719 B1
(45) Date of Patent: Nov. 4, 2003

(54) FUZE EXPLOSIVE TRAIN DEVICE AND METHOD

(75) Inventors: Gary A. Pacella, Stroudsburg, PA (US); Barry D. Schwartz, Newton, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 1 day.

(21) Appl. No.: 10/055,267

(22) Filed: Jan. 18, 2002

Related U.S. Application Data

(63) Continuation-in-part of application No. 09/810,713, filed on Mar. 19, 2001, now abandoned, which is a continuation of application No. 09/352,135, filed on Jul. 13, 1999, now abandoned.

(60) Provisional application No. 60/118,774, filed on Jan. 11, 1999.

(51) Int. Cl.[7] ..... C06D 5/00

(52) U.S. Cl. ..... 102/277.1; 102/204; 102/275; 102/396; 102/487; 102/499

(58) Field of Search ..... 102/204, 228, 102/232, 238, 248, 255, 266, 268, 269, 271, 275, 275.6, 275.11, 276, 277.1, 277.2, 396, 487, 488, 499, 500

(56) References Cited

U.S. PATENT DOCUMENTS

| | | | | | |
|---|---|---|---|---|---|
| 1,338,802 | A | * | 5/1920 | Walker | 102/275 |
| 2,948,219 | A | * | 8/1960 | Sapp | 102/204 |
| 3,638,572 | A | * | 2/1972 | Menichelle | 102/275 |
| 4,013,013 | A | * | 3/1977 | Davis | 102/277.1 |
| 4,326,461 | A | * | 4/1982 | Toms | 102/277 |
| 4,421,033 | A | * | 12/1983 | Dupont | 102/232 |
| 4,612,857 | A | * | 9/1986 | Schimmel | 102/204 |
| 4,614,156 | A | * | 9/1986 | Colle, Jr. et al. | 102/312 |
| 4,619,200 | A | * | 10/1986 | Bell | 102/275 |

OTHER PUBLICATIONS

Lyman Reloading Handbook For Rifle, Pistol and Muzzle Loading 1970, p. 223.*

* cited by examiner

*Primary Examiner*—Harold J. Tudor
(74) *Attorney, Agent, or Firm*—John F. Moran; Michael C. Sachs

(57) ABSTRACT

A fuze explosive train device for detonating a munition that uses a stab firing pin within a pressure cartridge, with the stab firing pin located between a gas generator and a stab detonator. The firing pin is capable of transferring an energy from the gas generator into the stab detonator in a manner that initiates the stab detonator to a high order explosive reaction. A method of initiating a stab detonator using a stab firing pin also is disclosed.

9 Claims, 3 Drawing Sheets

FUZE EXPLOSIVE TRAIN DEVICE AND METHOD

CROSS-REFERENCE TO RELATED APPLICATION

This application is a continuation-in-part application of co-pending U.S. patent application, Serial No. 09/810,713 filed Mar. 19, 2001 now abandoned, which is a continuation of U.S. patent application Ser. No. 09/352,135, filed on Jul. 13, 1999, now abandoned, which claims benefit of U.S. provisional application No. 60/118,774, filed on Jan. 11, 1999, which are incorporated herein by reference in their entirety.

GOVERNMENT INTEREST

The invention described herein may be manufactured, licensed, and used by or for the U.S. Government.

1. Field of the Invention

The present invention relates to a firing mechanism for munition rounds. More particularly, the firing mechanism uses an assembly with a stab firing pin to delay detonation of a munition round after initial contact with a target. The stab firing pin is seated within a supporting disk in a pressure cartridge for proper and reliable firing of the munition warhead.

2. Background Art

The survival of a military unit depends to a great extent on its ability to defeat enemy armor and field fortifications. Substantial improvements in the effectiveness of armor and fortifications to withstand exploding munitions has occurred. Layered defenses and reinforced structures are generally designed to deflect the explosive force of a munition away from a target, or to absorb part of the destructive force as a way to dissipate the damaging effects of the munition. Munitions with a delayed warhead detonation, after target impact, have increased effectiveness in damaging or destroying the target. The delayed timing provides the maximum explosive effect of the munition against the target.

The delayed timing of an exploding munition, after impact, may be required for several reasons. The purpose of the delay is to produce the greatest target effect or efficiency from the warhead. Some munitions penetrate the target without detonating and then function once inside. Other munitions utilize timing between multiple warheads to create the greatest effect against armor. In plastic or squash head warheads, the warhead deforms on target impact and spreads explosive against the target. These warheads must allow a certain amount of deformation to occur before detonating. However, a time delay that is either too rapid or too slow drastically reduces the efficiency of the warhead. Additionally, the reliability of munition detonation must remain extremely high. Detonation reliability in excess of at least 94 percent is normally desired, with detonation reliability in the range of 98 percent or more commonly accepted for weapon use. Additionally pressure cartridges within a munition used to create a timing delay should be able to withstand a certain amount of rough handling.

Three types of methods are commonly used for delaying the initiation of an explosive: chemical or pyrotechnic, mechanical, and electric.

Pyrotechnic delays, generally considered the oldest method, uses a low order burn to initiate or transition a primary explosive into a high order explosion. An example of a pyrotechnic delay is a burning cord used to set off a bomb or stick of dynamite. Pyrotechnic delays are inexpensive although timing accuracy and reliability may not be as high as other methods. Problems arise in trying to make pyrotechnic delays short, such as delays of less than about 1 millisecond. A ½ millisecond delay of a pyrotechnic having a low order burn composition comprising Barium Chromate, Boron, and A1A Powder, may require, for example, the pyrotechnic delay to be only about 0.0008 inches long. Such a delay, while theoretically possible, would be near impossible to manufacture. A 2 millisecond delay using a high explosive, such as HNS as a delay medium which has reaction rates much faster than a pyrotechnic delay blend, requires about 13 inches of material length which is generally impractical in most munitions.

Mechanical delays, or clockworks, use a spring mechanism that stabs a detonator to start an explosive reaction. These mechanical timers, however, are unable to provide accurate short delays, such as less than about 10 millisecond. Electronic timers are today's state of the art, used to set off an electric detonator. Although electronic timers may be constructed to accurately function at extremely short time periods, the size of the circuit and power supply even in the smallest electronic timers may be too large for many applications, In view of the foregoing, there is a need for improvements in the delay timing of cartridges used in exploding munition rounds.

Summary of the Invention

An object of the present invention is to provide a reliable timing delay for the detonation of a munition round.

The present invention includes a fuze explosive train device for detonating a munition, comprising a pressure cartridge having a stab firing pin located adjacent to a gas generator and a stab detonator on the opposite side of the stab firing pin from the gas generator, wherein the stab firing pin is capable of transferring an energy from the gas generator into the stab detonator effective to initiate the stab detonator.

The present invention further includes a method of initiating a stab detonator within a pressure cartridge comprising the steps of providing a device for detonating a munition comprising a pressure cartridge having a stab firing pin located adjacent to a gas generator and a stab detonator on the opposite side of the stab firing pin from the gas generator, wherein the stab firing pin is capable of transferring an energy from the gas generator into the stab detonator effective to initiate the stab detonator; and, causing a chemical reaction that transfers energy from the gas generator onto the stab firing pin, wherein the stab firing pin is forced into the stab detonator effective to initiate the stab detonator.

The present fuze explosive train device uses the successive initiations of the following delays: a pyrotechnic delay, followed by a mechanical delay caused by the rupture of the supporting disk and the transfer of energy across the first gap, a pyrotechnic delay, and then a mechanical delay across the second gap.

The supporting disk is an important part of the fuze explosive train device in that it seats and supports the stab firing pin, and further allows for a controlled mechanical delay upon rupture, which feature is lacking in conventional fuze explosive train devices. The disk is generally flat and circular in shape.

The rupturing of the supporting disk is also an important aspect of the fuze explosive train device as it allows for a very precise control of the mechanical delay, by controlling the material and thickness of the disk.

Yet another important feature of the fuze explosive train device is that the firing pin is freed following the pyrotechnic delay. The stab firing pin of the fuze explosive train device is seated within the supporting disk, and is capable of free movement. In this way, the free movement stab firing pin is not held back by a piston, or significantly affected by the resonance of the piston. As such, the present design achieves an accurate control of the delay mechanism.

BRIEF DESCRIPTION DRAWINGS

DETAILED DESCRIPTION OF THE PREFERRED EMBODIMENTS

The present invention is a fuze explosive train device for detonating a munition, and a method for using the device. The device comprises a pressure cartridge used within the fuze of a munition round for timing the detonation of the munition after impact with a target and ensuring the reliability of detonation. The pressure. cartridge has a stab firing pin located between a gas generator and stab detonator of the pressure cartridge to transfer energy between the two components, and to ensure the detonation or initiation of the stab detonator.

The manner in which a stab detonator is initiated has been found to provide a significant difference in the reliability of the fuze, which in turn affects the reliability of the detonation of an explosive train within the munition that extends from the front of the gas generator and continues into the lead. Generally, the length of the explosive train is from about 5 inches or less, with lengths of from about 0.8 inches to about 1.0 inches common.

The present invention is particularly suited for incorporation in the XM141, Shoulder Launched Multipurpose Assault Weapon—Disposable Bunker Defeat Munition (BDM/SMAW-D) manufactured by Talley Defense Systems of Mesa, Arizona that is used by the United States Army. It is also suitable for the SMAW munition, formerly manufactured in Titusville, Fla. by McDonnell Douglass of St. Louis, Mo., that is used by the United States Marine Corps. Other potential uses include in the TOW missiles, and other munitions needing a delayed explosion after target contact. Additionally, the present invention is suitable for civilian uses for delayed detonation of a high order explosive, with such uses non-exclusively including fireworks, crash-testing, search and rescue operations that require structure penetration, and other applications of the device that generally require a reliable delayed detonation to occur.

Figure 1A:
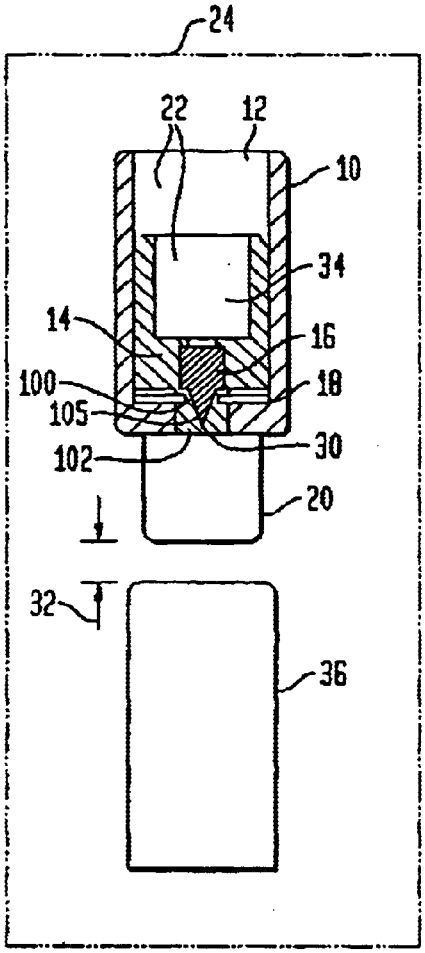
FIG. 1A is a longitudinal cross-sectional view of a fuze of the present invention showing the stab firing pin and supporting disk in position prior to firing.
Figure 1B:
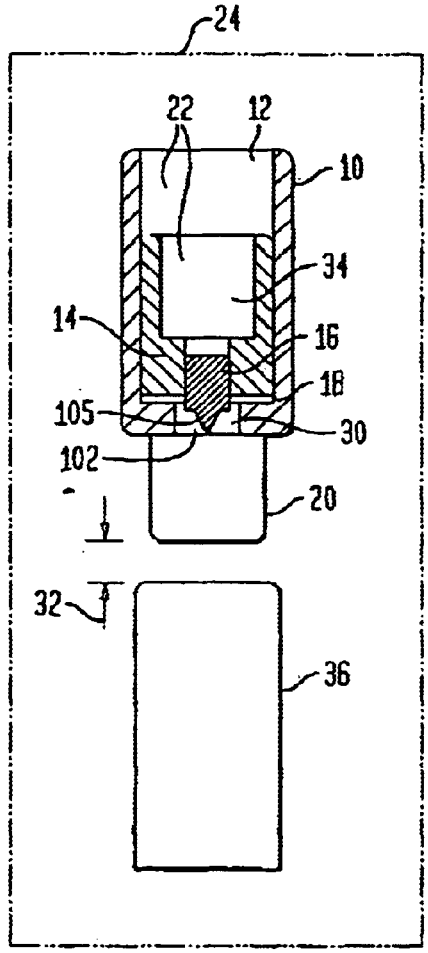
FIG. 1B is another longitudinal cross-sectional view of the fuze of FIG. 1, showing the stab firing pin and supporting disk subsequent to firing.
Figure 3A:
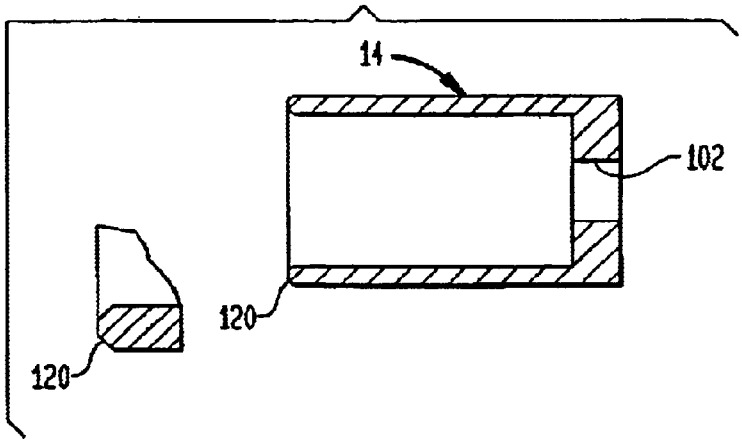
FIG. 3A is a side (or longitudinal) cross-sectional view of a holder, forming part of the fuze of FIGS. 1A and 1B.

Referring to FIGS. 1A and 1B, a pressure cartridge 10 of the present invention is shown. The pressure cartridge 10 is a component part of a fuze 24. The pressure cartridge 10 comprises a primer assembly 12 contiguous to a holder 14 containing an explosive material. Together the primer assembly 12 and explosive material in the holder 14 comprise a gas generator 22 of the pressure cartridge 10. On the opposite side of the holder 14 from the primer assembly 12, a stab firing pin 16 is positioned within and/or adjacent to the holder 14. As shown in FIG. 3A, the holder 14 includes a chamfered edge 120.

As illustrated in FIG. 1A, prior to firing, the stab firing pin 16 rests on, and partly within a supporting disk 18 to maintain its positioning in relation to the holder 14. As illustrated in FIG. 1B, upon firing, the firing pin 16 ruptures the supporting disk 18 and advances toward the stab detonator 20.

Figure 3B:
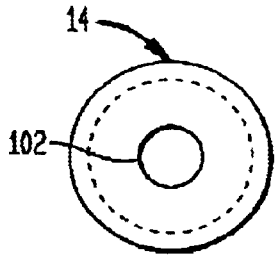
FIG. 3B is a bottom view of the holder of FIG. 3A.
Figure 4A:
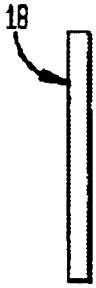
FIG. 4A is an enlarged, side view of the disk of FIGS. 1A and 1B.
Figure 4B:
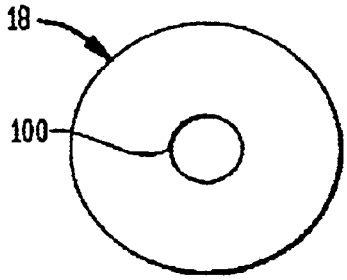
FIG. 4B is an enlarged, top plan view of the disk of FIG. 4A.

The supporting disk 18 is an important part of the fuze explosive train device 24 in that it seats and supports the stab firing pin 16, and further allows for a controlled mechanical delay upon rupture. As shown in FIGS. 4A and 4B, the supporting disk 18 is generally flat and circular in shape, with a central circular opening 100 that is generally co-aligned with an opening 102 (FIGS. 3A, 3B) in the bottom of the holder 14, and a tip 105 (FIGS. 1A, 1B) of the firing pin 16.

With reference to FIGS. 1A and 1B, prior to firing, the tip 105 of the firing pin 16 protrudes, within the opening 100 of the supporting disk 18, beyond the surface of the supporting disk 18, while the body of the firing pin 16 rests on the surface of the supporting disk 18. In this pre-firing position, the tip 105 of the firing pin 16 protrudes within the opening 102 of the holder 14, but does not extend beyond it, and is separated from the stab detonator 20 by the gap 30.

Upon firing, and subsequent to the rupturing of the supporting disk 18, the tip 105 of the firing pin 16 travels through the gap 30, into contact with the stab detonator 20. The rupturing of the supporting disk 18 is an important aspect of the fuze explosive train device 24 as it allows for a very precise control of the mechanical delay. This is achieved by controlling the material and thickness of the supporting disk 18.

Yet another important feature of the fuze explosive train device 24 is that the firing pin 16 is freed following the pyrotechnic delay. The stab firing pin 16 is seated in part within the supporting disk 18, and is capable of free movement. In this way, the free movement stab firing pin 16 is not held back by a piston, or significantly affected by the resonance of the piston. As such, the present design achieves an accurate control of the delay mechanism.

A stab detonator 20 is positioned adjacent to the pressure cartridge 10. The pressure cartridge 10 extends beyond the forward point of the stab firing pin 16, creating a gap 30 between the stab firing pin 16 and the stab detonator 20. On the opposite side of the gap 30 from the stab firing pin 16, a stab detonator 20 is fixed within the fuze 24 and positioned for stabbing by the stab firing pin 16. With the detonation of the gas generator 22, the stab firing pin 16 transfers the potential energy from the gas generator 22 into the stab detonator 20. As such, the potential chemical energy of the gas generator 22 imparts kinetic energy into the stab firing pin 16.

The stab firing pin 16 is projected into the stab detonator 20 at a rate of travel to cause sufficient frictional interaction between the stab firing pin 16 with explosive material in the stab detonator 20 to initiate the stab detonator 20 to detonate or explode. The explosive force of the stab detonator 20 transfers across a gap 32 between the stab detonator 20 and a lead 36, and initiates the explosive with the lead 36 of the munition that causes the warhead of the munition to explode.

The stab detonators 20 and leads 36 may range in any suitable length for a particular munition, with the proper length being determinable by those skilled in the art. For example, stab detonators 20 having a length of from about 0.1 to about 0.2 inches, and leads 36 having a length of from about 0.3 inches to about 0.4 inches are common.

The stab firing pin 16 comprises any suitable configuration for initiation of the stab detonator 20. Generally, as the shape of the stab firing pin 16 becomes more blunt, a greater amount of kinetic energy of the stab firing pin 16 is required to provide sufficient frictional contact between the stab firing pin 16 and the stab detonator 20 to initiate an explosive reaction of the stab detonator 20. A tapered stab firing pin 16 configuration is preferred to decrease the amount of kinetic energy required in detonating the stab detonator 20. Other configurations, such as a sharp leading edge, or a leading edge containing single or multiple points, ridges, and/or other appropriate shapes of the stab firing pin 16 may be formed for specific amounts of imparted kinetic energy, with a particular shape for a given energy level determinable by those skilled in the art.

Preferably, the friction of the stab firing pin 16 initiates a high order explosive reaction of the explosive material within the stab detonator 20.

A high order explosive reaction within the stab detonator 20 is required for the proper functioning of the fuze 24 and munition warhead. An example of the stab detonator is the M55 manufactured by Action Manufacturing of Atglen, Pa. or Day and Zimmerman at the Lonestar Army Ammunition Plant in Tex. Texas that is used by the United States Army. Although the necessary fuze 24 reliability for a given munition is subjective, unexploded munitions generally pose an unacceptable danger, and as such, fuze 24 reliability should approach at least about 94 percent or more, with increasing high degrees of reliability preferred, such as from about 98 percent or greater, more preferably from about 99.5 percent or greater, and still more preferably from about 99.9 percent or greater. Most preferred is a reliability that approaches a failure rate of less than about 1 in 10,000 or better.

The stab firing pin 16 may comprise any material composition that permits it to impart a frictional explosive detonation of the stab detonator 20. Preferably the stab firing pin 16 comprises a metal material, such as copper, bronze, steel, and/or other metals that are able to provide suitable frictional contact with the stab detonator 20 for detonation. Most preferably the stab firing pin 16 comprises a steel composition or component.

The gap 30 between the stab firing pin 16 and the stab detonator 20 is a sufficient distance to impart a functional kinetic energy to the stab firing pin 16. Functional kinetic energy is an amount of energy that detonates the stab detonator 20 in a given munition. As such, the size of the gap 30 is affected by the composition of stab firing pin 16, the energy provided by the gas generator 22, and other factors known to those skilled in the art. Preferably, the size of the gap 30 ranges from about 0.001 inches to about 0.1 inches, more preferably from about 0.003 inches to about 0.05 inches, and most preferably from about 0.005 inches to about 0.03 inches.

The supporting disk 18 fixes the position of the stab firing pin 16 within the pressure cartridge 10. The supporting disk 18 stabilizes the stab firing pin 16 while the holder 14 ensures proper alignment. The supporting disk 18 secures the stab firing pin 16 to ensure no unintentional contact with the stab detonator 20 occurs during normal movement and rough handling of the munition.

Additionally, the supporting disk 18 shears or ruptures with the movement of the stab firing pin 16, after firing. The supporting disk 18 comprises a material and thickness that functions to stabilize and align the stab firing pin 16, while permitting the rupture required to free the stab firing pin 16 to impale the stab detonator 20 after a desired time delay from the impact of the munition with a target. The supporting disk 18 preferably has a thickness of from about 0.0005 inches to about 0.01 inches, more preferably from about 0.001 inches to about 0.007 inches, and most preferably from about 0.0025 inches to about 0.0035 inches. The composition of the supporting disk 18 may comprise a metal, such as copper, bronze and/or steel, a polymer composite, and/or other suitable compositions for rupturing. Preferably, the composition of the supporting disk 18 comprises steel.

In summary, the present fuze explosive train device 24 uses the successive initiations of the following delays: a pyrotechnic delay, followed by a mechanical delay caused by the rupture of the supporting disk 18 and the transfer of energy across the first gap 30, a pyrotechnic delay, and then a mechanical delay across the second gap 32.

The primer assembly 12 of the present invention contains a pyrotechnic material that ignites under pressure. An example of the primer assembly 12 is the M42 primer manufactured by Olin Corporation of East Alton, Ill. that is used by the United States Army. The flash from the primer assembly 12 imparts energy into the pyrotechnic material within the holder 14, such as ball powder, to ignite it. Preferably, the amount of ball powder within the holder 14 is from about 30 milligrams to about 0 milligrams, more preferably from about 20 milligrams to about 5 milligrams, and most preferably from about 15 milligrams to about 10 milligrams. However, even without the detonation of the ball powder, or with the absence of the ball powder, the present invention may possess sufficient kinetic energy to properly function in reliably causing detonation of the munition. Deflagration of the ball powder may further increase the reliability of the fuze 24. The primer assembly 12 and holder 14 may comprise any suitable material for retaining an energetic material, with the material preferably being a polymeric composite or a metal, such as copper, bronze and/or steel, with steel being most preferred.

The Langlie Test Method

A common method of determining the reliability of explosive trains or explosive elements is to perform a Langlie test as described in "A Reliability Test Method for "One Shot" Items,@ by H. J. Langlie, Aeronutronic Division of Ford Motor Co., Aug. 10 1962, the disclosure of which is herein incorporated by reference. The Langlie test method is designed for testing "one shot" items, such as an explosive train. The testing of numerous one shot items presents many unique concerns. First, each item can only be tested once. Second, the critical value under test, or strength of the test item, is expected to vary in some statistical manner. Lastly, only a sample from a lot can be tested since test items are consumed in testing.

Three significant steps are part of the Langlie test: setting the criteria, performing the test, and analyzing the results. In the first step, the variable of a test must be determined. This variable is called the stress. Additionally, each test sample has a characteristic that causes it to pass or fail each its test. This characteristic is called its strength. If the stress on each test sample is greater that strength of each test sample, the test sample will fail. For the present invention, the criteria of the Langlie test included the variable or stress defined as the gap 32 between the stab detonator 20 and the lead 36. The pass/fail criteria for the Langlie test reflected the reaction force of the lead 36. In testing the test samples, the lead 36 was fired into a steel witness block. If the lead 36 dented the steel block, the test sample was recorded as a pass. The limits, or range, of the Langlie test were also set within the criteria having the range large enough to include a low extreme where the test sample is guaranteed to pass, and a high extreme where the test sample is guaranteed to fail. The range for the Langlie test on the present invention was set at limits of from about 0 inches to about 1 inch. Originally, in the Langlie test a new stress level was selected after each test sample was tested which provided the most accurate finding at the 50% point. The original Langlie test worked well for determining both the stress where all the units would pass and the stress where all the units would fail. In a modified version of the Langlie test, performed on the present invention, multiple test samples are tested at each stress. The modified Langlie test provided significant information related to determining stress where all test samples at the stress either pass or fail. Using the modified Langlie test for the present invention, a maximum of three units were tested at each stress level. If all three units at that stress were a pass, the stress was increased. As soon as one unit failed at a given stress, the stress was decreased.

The modified Langlie test began at the stress that was the average of the two limits. The second stress level was determined by averaging the first stress and one of the limits. If the first stress were a pass, then averaging of the first stress occurred with the upper limit. If the stress were a fail, then averaging occurred with the lower limit. After the second stress, subsequent stresses were selected by counting back through the preceding stresses until an equal number of passes and failures resulted at a stress. An average of the most recent stress with the previously defined stress determined the new stress. When there was no point that had an equal number of passes and failures from the previous results, then an average between that last stress and the appropriate limit was used. If the last test were a failure, for example, then an average with the lower limit was used.

In analyzing or interpreting the test results, data from the test was placed in the form of stress data S=(s1,s2, . . . sn) and corresponding outcome data U=(u1,u2, . . . un). An iterative process was used to calculate a mean and standard deviation of the test sample strengths which maximizes the likelihood, or probability, of obtaining the outcomes U given stresses S. The mean and standard deviation obtained were estimates of the actual mean and standard deviation of the test sample population. Based on the data and the number of samples, ranges around the estimated mean and standard deviation were calculated for a given probability of containing the actual mean and standard deviation. The range provided a confidence limit of the test samples. In tests performed on present invention investigated the stab detonator 20 having the ability to jump a gap 32 to the lead 36, the strength of the test, which is larger than the actual gap 32 present, or stress. It was assumed that the mean was on the low end of the range at a given confidence, for example 90% of containing the actual mean, and that the standard deviation was on the high end of the range at the same confidence of including the actual standard deviation. For example, if the gap 32 is the three worst case standard deviations below the worst case mean, then it is predictable with 90% confidence that the design is at least 99.8% reliable.

Figure 2:
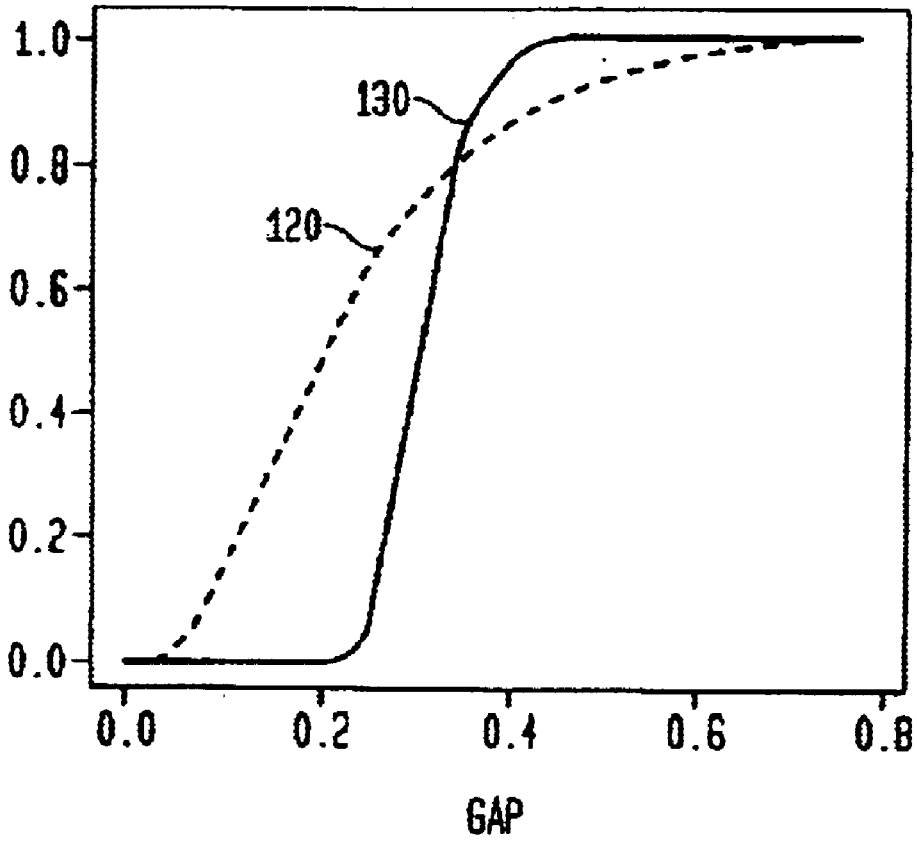
FIG. 2B is a graph showing a reliability comparison of an explosive train detonation with and without a stab firing pin as related to the transfer versus gap.

FIG. 2 shows the results of a Langlie test run using a baseline Mk420 for both a fuze 24 with a pressure cartridge without the stab firing pin 16, shown as a dotted line 100, being used to set off the stab detonator 20, and a Mk420 fuze 24 having the stab detonator 20 initiated with the stab firing pin 16, shown as a solid line 110. The variable gap 32 along the x-axis for the test represented the distance within the explosive train between the stab detonator 20 and the lead 36. A test was considered a success when the lead 36 functioned high order shows the predicted probability of FIG. 2 high order function of the lead 36 for a given gap 32 between the stab detonator 20 and the lead 36. In FIG. 2, the higher the number along the y-axis, the more unreliable to fuze 24.

As seen in FIG. 2 the detonation may not transfer into the stab detonator 20 even at small gaps for the fuze 24 when no stab firing pin 16 is attached to the pressure cartridge, as shown in a dotted line 120. Without the stab firing pin 16, gaps 32 as low as about 0.05 inches show a poor reliability rate. The solid line 130 in FIG. 2 shows the predicted probability of high order function of the lead 36 for a given gap 32 between the stab detonator 20 and the lead 36 for the Mk420 fuze 24 having the stab detonator 20 initiated with the stab firing pin 16.

As seen in FIG. 2, the stab detonator 20 does not reliably achieve, high order detonation when the explosive train does not contain the stab firing pin 16. However, the symmetry shown for various gaps 32 in an explosive train containing the stab firing pin 16 of the present invention shows the stab detonator 20 reliably achieving high order detonation.

The manner in which the stab detonator 20 is initiated affects fuze 24 reliability, with the incorporation of the stab firing pin 16 within the explosive train significantly increasing fuze 24 performance. FIG. 2 evidence that the pressure cartridge assembly of the present invention, as illustrated in FIG. 1A, provides an extremely reliable detonation transfer rate for various sizes of gaps 32, with the gap 32 preferably having a size of from about 0.20 inches or less, more preferably from about 0.18 or less, still more preferably from about 0.15 inches or less, and most preferably from about 0.06 inches or less.

In operation, the stab detonator 20 is initiated to a high order explosive reaction from the pressure cartridge 10 as previously described by causing a rapid chemical reaction within the gas generator 22. The rapid chemical reaction transfers energy from the gas generator 22 onto the stab firing pin 16 such that the stab firing pin 16 is forced into the stab detonator 20 with enough kinetic energy to initiate or detonate the stab detonator 20. Rapid chemical reactions are known as "burning" reactions rather than detonations, with a burning reaction having a lower rate of combustion than a detonation as understood by those skilled in the art.

The relatively low rate of chemical reaction combustion within the gas generator 22 and delay incurred by the rupture of the supporting disk 18 permits sufficient time delay between the munition contacting a target and the explosion of the munition warhead. Preferably, the time delay ranges from about 1 microseconds to about 1000 microseconds, more preferably from about 50 microseconds to about 700 microseconds, and most preferably from about 300 microseconds to about 600 microseconds . Timing of the delay may be varied to suit a given purpose or weapon system with the amount of delay required for a given purpose determinable by those skilled in the art.

Comparative Example 1

The Mk420, manufactured by Action Manufacturing of Philadelphia, Pa. was tested using a pressure cartridge without a stab firing pin. The pressure cartridge used an explosive that initiated the stab detonator with explosive gas residue. Fuze failure rate was 16 out of 187, or a 8.6 percent failure rate. Analysis of the fuzes showed that the fuzes had fully armed, but the stab detonator had functioned with a low order explosive reaction.

Example 1

In a laboratory, 234 fuzes were tested that contained the stab firing pin incorporated into the pressure cartridge. The gap between the detonator and the lead was held at a range of from about 0.030 inches to about 0.060 inches, and the gap between the stab firing pin and stab detonator was held at a range of from about 0.005 inches to about 0.030 inches. The stab firing pins were held in place by a single supporting disk, with the disk rupturing 100 percent of the time. There were no low order functions observed in the test. The fuzes demonstrated a 99.1 percent reliability, with a 90 percent confidence.

Example 2

Example 1 was conducted using two disks within each fuze to hold the stab firing pins. Several of the fuzes worked, however, at least one failure was noted indicating the need to ensure single disk installation to secure the stab firing pin.

It should be understood that the foregoing summary, detailed description, examples and drawings of the invention are not intended to be limiting, but are only exemplary of the inventive features which are defined in the claims.

What is claimed is:

1. A fuze explosive train device for delaying detonation of a munition after impact with a target, comprising:

a pressure cartridge including a stab firing pin located intermediate a gas generator, and a supporting disk, said supporting disk having a thickness of from about 0.0005 inch to about 0.01 inch;

the stab firing pin being seated within the supporting disk, wherein the supporting disk stabilizes the stab firing pin;

a stab detonator disposed at a distance from the stab firing pin so that a first gap is formed therebetween said first gap being about 0.001 inch to about 0.1 inch;

a lead disposed across a second gap from the stab detonator;

wherein the gas generator transfers energy to the stab firing pin after a pyrotechnic delay, forcing the stab firing pin to move in the first gap toward the stab detonator, and further causing the supporting disk to rupture with the movement of the stab firing pin;

wherein the rupturing of the supporting disk provides a predetermined mechanical delay;

wherein the mechanical delay is controlled by a selective choice of material and thickness of the disk; and wherein the rupturing of the supporting disk frees the stab firing pin to initiate the stab detonator following the predetermined mechanical delay, and to transfer an explosive energy of the stab detonator across the second gap to initiate the lead in order to ignite the device.

2. The fuze explosive train device of claim 1, wherein the pressure cartridge comprises a holder that aligns the stab firing pin within the supporting disk.

3. The fuze explosive train device of claim 1, wherein the initiation of the stab detonator causes an explosive reaction.

4. The fuze explosive train device of claim 1, wherein the stab firing pin has a tapered configuration.

5. Thee fuze explosive train device of claim 1, wherein the stab firing pin is made at least in part of a metal material.

6. The fuze explosive train device of claim 5, wherein the stab firing pin is made at least in part of steel.

7. The fuze explosive train device of claim 1, wherein the stab firing pin is positioned from about 0.005 inch to about 0.03 inch from the stab detonator.

8. The fuze explosive train device of claim 1, wherein the supporting disk is made at least in part of steel.

9. The fuze explosive train device of claim 1, wherein the gas generator contains ball powder.

* * * * *